United States Patent [19]

Kich

[11] Patent Number: 4,677,403

[45] Date of Patent: Jun. 30, 1987

[54] TEMPERATURE COMPENSATED MICROWAVE RESONATOR

[75] Inventor: Rolf Kich, Redondo Beach, Calif.

[73] Assignee: Hughes Aircraft Company, Los Angeles, Calif.

[21] Appl. No.: 809,447

[22] Filed: Dec. 16, 1985

[51] Int. Cl.[4] ..... H01P 7/06; H01P 1/207; H01P 1/30

[52] U.S. Cl. ..... 333/229; 333/209; 333/232; 333/234

[58] Field of Search ..... 333/227–233, 333/252, 208–212; 333/234, 235, 248, 239

[56] References Cited

U.S. PATENT DOCUMENTS

| | | | |
|---|---|---|---|
| 2,436,700 | 2/1948 | Spielman | 315/39 |
| 3,173,106 | 3/1965 | McCulloch | 331/98 |
| 3,252,116 | 5/1966 | Painter | 333/229 |
| 3,414,847 | 12/1968 | Johnson | 333/229 |
| 3,873,949 | 3/1975 | Dorsi et al. | 333/229 X |
| 3,902,138 | 8/1975 | Hopper | 331/39 |
| 4,156,860 | 5/1979 | Atia et al. | 333/229 |
| 4,423,398 | 12/1983 | Jachowski et al. | 333/229 |
| 4,488,132 | 12/1984 | Collins et al. | 333/229 |

*Primary Examiner*—Marvin L. Nussbaum

*Attorney, Agent, or Firm*—Joseph A. Sawyer, Jr.; Mark J. Meltzer; A. W. Karambelas

[57] ABSTRACT

A microwave resonator is disclosed which includes a temperature-compensating structure within the resonator cavity configured to undergo temperature-induced dimensional changes which substantially minimize the resonant frequency change otherwise caused by temperature-induced changes in the waveguide body cavity. The temperature-compensating structure includes both bowed and cantilevered structures on the cavity endwall, as well as structures on the cavity sidewall such as a tuning screw of temperature-responsive varying diameter.

23 Claims, 6 Drawing Figures

FIG. 4
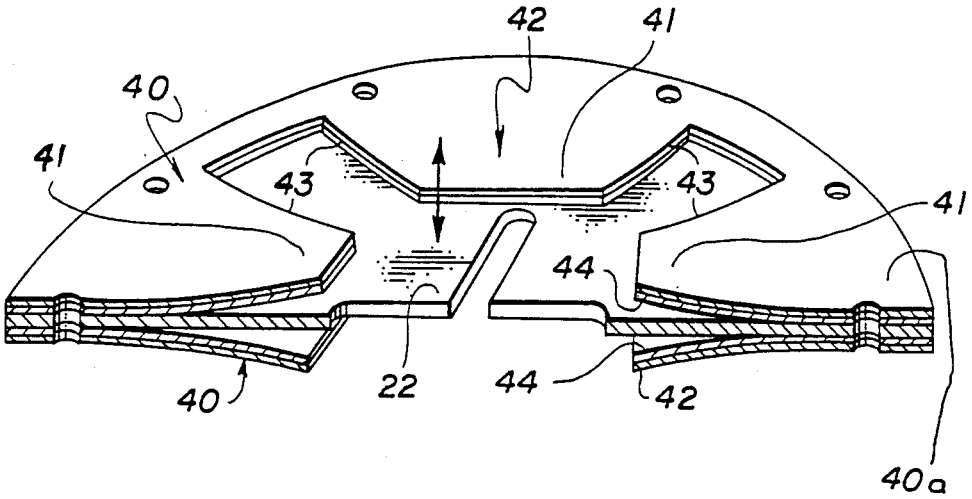
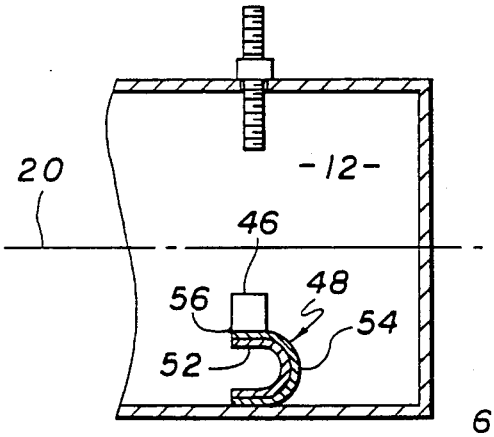
FIG. 5
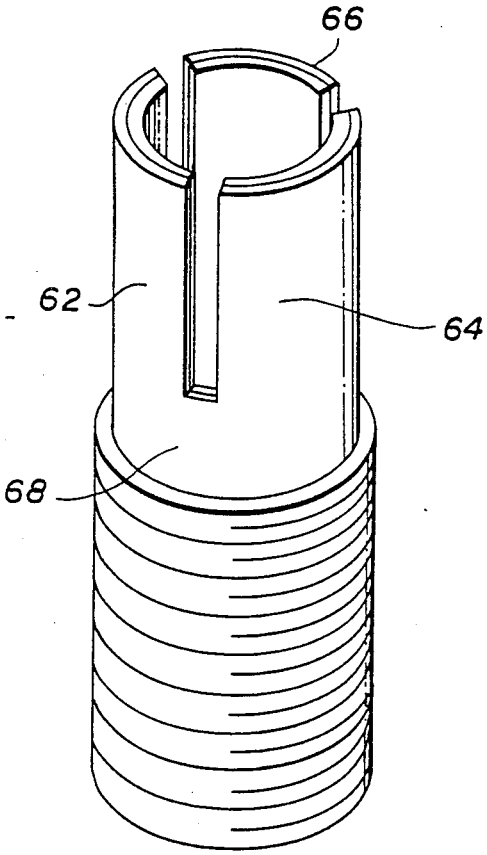
FIG. 6

TEMPERATURE COMPENSATED MICROWAVE RESONATOR

BACKGROUND OF THE INVENTION

A microwave resonator is essentially a tuned electromagnetic circuit which passes energy at or near a resonant frequency. It can be used as a filter to remove electromagnetic signals of unwanted frequencies from input signals and to ouput signals having a preselected bandwidth centered about one or more resonant frequencies.

The resonator comprises a generally tube-like body through which electromagnetic waves are transmitted. Typical shapes used for such resonators include cylinders, rectangular bodies, and spheres, although shape in itself is not a limitation of the present invention. The electromagnetic energy is typically introduced at one end by such means as capacitive or inductive coupling. The side walls of the resonator cavity act as a boundary which confine the waves to the enclosed space. In essence, the electromagnetic energy of the fields propagating through the waveguide are received at the downstream end by means of reflections against the walls of the cavity.

The resonant frequency associated with the waveguide is a function of the cavity's dimensions. Accordingly, a change in temperature causes the resonant frequency to change owing to expansion or contraction of the resonator material, which causes the effective dimensions of the cavity to change.

It has therefore been the practice to construct such resonators from relatively expensive temperature-stable materials such as an invar nickel-steel alloy (herein referred to as "invar steel"). Even the use of such materials, however, has not been a wholly acceptable solution to frequency shift. At 12 GHz, for example, it has been found that an invar steel resonator shifts 0.9 MHz over a typical communications satellite's operating temperature. In some applications, a shift of that magnitude is excessive and causes performance to be compromised.

Broadly, the present invention provides a temperature-compensating resonator for reducing such frequency shifts. Such resonator comprises a waveguide body having a cavity sized to maintain electromagnetic waves of one or more selected resonant frequencies, means for coupling electromagnetic energy into and out of the resonator, and temperature-compensating structure within the cavity configured to undergo temperature-induced dimensional changes which minimize the resonant frequency change that would otherwise be caused by the temperature-induced dimensional change of the waveguide cavity.

Even when a resonator made of invar steel or the like provides acceptable frequency stability in the face of temperature change, the use of such material presents disadvantages for some applications such as satellite communication.

First, invar steel is a relatively heavy material and is therefore disadvantageous where payload weight is an important factor. Second, invar steel, as well as other low thermal coefficient materials, possesses low thermal conductivity. In state of the art high-power communication satellites, a substantial amount of heat must be dissipated. In some cases, temperatures may be reached which can melt the steel. Invar's poor heat conductivity requires that active means for cooling the resonators be employed. Accordingly, additional weight and space must be dedicated to the cooling of these components; provision must be made for the size and weight associated with the cooling hardware and its associated power requirements.

Accordingly, in one form the present invention is directed to a cavity resonator particularly suitable for use in high-power communication satellites. The resonator comprises a body made of a relatively light weight, thermally conductive material that has heretofore been inappropriate for such applications because of associated high thermal expansion co-efficients. Such resonator includes temperature-compensation means for substantially offsetting temperature-induced changes in resonant frequency caused by dimensional changes in the cavity dimensions. In a preferred form this resonator utilizes a bimetallic temperature compensation means to accommodate the larger temperature-induced changes in the resonator cavity. Accordingly, such materials can be used which have advantages over invar steel. For example, lighter, more easily machined, higher conductivity metals such as aluminum can be used despite the fact that their temperature coefficients have heretofore limited their use.

BRIEF DESCRIPTION OF THE DRAWINGS

More specific details and advantages concerning the invention will become apparent from consideration of the following detailed description of a preferred embodiment of the invention, of which the following drawing is a part:

FIG. 4 is a perspective view in section of an alternative embodiment of a thermally compensating coupling iris constructed in accordance with the invention;

FIG. 5 is a fragmentary longitudinal sectional view showing an alternative embodiment of a cavity resonator constructed in accordance with the invention; and FIG. 6 is a perspective view of a tuning screw for use in a cavity resonator constructed in accordance with the invention.

DESCRIPTION OF THE PREFERRED EMBODIMENT

Figure 1:
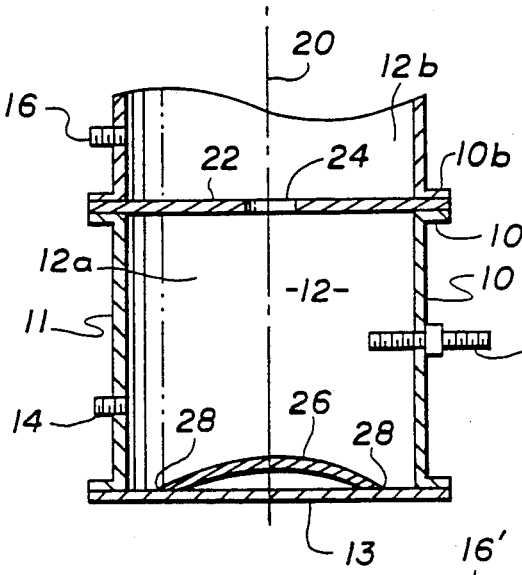
FIG. 1 is a longitudinal sectional view, in schematic, illustrating a waveguide resonator constructed in accordance with the invention.

FIG. 1 is a longitudinal sectional view, in schematic, of a preferred embodiment of a cavity resonator constructed in accordance with the present invention. As is known in the art, the cavity resonator is, in effect, a tuned circuit which is utilized to filter electromagnetic signals of unwanted frequencies from input electromagnetic energy and to output signals having a preselected bandwidth centered about one or more resonant frequencies. The resonator comprises a waveguide body 10, having a generally tubular sidewall 11 generally disposed about a central axis 20, and a pair of endwalls, one of which 13 is illustrated.

The illustrated resonator additionally includes a generally circular, flat coupling iris 22 which divides the interior of the waveguide body 10 into a pair of cavities 12*a*,12*b*. The iris effectively serves as an endwall member to define the axial dimension of cavity 12*a* in conjunction with endwall 13. As used herein, the terms "endwall" and/or "endwall member" will accordingly be used to denote both endwalls and coupling irises. The coupling iris includes electromagnetic transmission means such as cross-shaped slot 24 which couples electromagnetic energy from cavity 12*a* into cavity 12*b*. Since the resonant frequencies of cavities 12*a*,12*b* may be different, the coupling iris permits the waveguide resonator to exhibit two selected resonant frequencies, each of which is determined by the respective lengths and diameters of the cavities 12*a*,12*b*.

Cavity resonators employing more than two cavities are wellknown and are within the purview of the invention. Such resonators employ the appropriate number of coupling irises to effectively divide the housing interior into the desired number of appropriately dimensioned cavities.

The illustrated housing 10 may be constructed of a plurality of open-ended tubular flanged housing sections. Each iris 22 is coupled between the flanges of adjacent housing sections. A pair of closure members can conveniently be coupled to the flanges at both ends of the resulting assembly to define the end walls of the two end cavities of the resonator.

The resonator of FIG. 1 includes means 14 for coupling electromagnetic energy into the resonator, means 16 for coupling electromagnetic energy out of the resonator, and a tuning screw 18 for manually fine-tuning the resonant frequency of the resonator. The coupling means 16 and the tuning screw 18, as well as their respective positioning on the resonator, are well-known in the art and, for the purpose of brevity, will not be described in detail herein.

Because the resonant frequency associated with each cavity is a function of the cavity's dimensions, an increase in temperature will cause dimensional changes in the cavity and, therefore, temperature-induced changes in the resonant frequency associated with the cavity. Specifically, an increasing temperature will cause thermal expansion of the waveguide body 10 to enlarge the cavity both axially and transversely.

Resonant frequency increases with decreased cavity length in the axial direction and increases with increased dimensional change in the transverse direction. Since the typical cavity has an axial dimension which is greater than its transverse dimension, a thermally-induced dimensional change in the axial direction will be greater than the change in the transverse direction. The net result is that a rise in temperature will result in a lowering of the resonant frequency associated with the cavity.

Accordingly, the resonator of FIG. 1 includes temperature-compensating structure 26 within the cavity 12*a*. The structure 26 is generally circular, disc-shaped and is affixed about its outer periphery to the housing by means such as solder or by being bolted to the end flange, where available. As explained below, the structure 26 is configured to undergo temperature-induced dimensional changes which minimize the resonant frequency change caused by the temperature-induced dimensional change of the waveguide cavity. By the term "configure", it is meant that the composition and/or shape of the compensating structure is adapted to have the desired effect.

In the embodiment of FIG. 1, the resonator includes a body of invar steel. The compensating structure 26 is formed as a 21.6 mm disk of 0.5 mm thick copper. The center of the disk is bowed away from the interior of the endwall by 1.27 mm and is coupled to the waveguide body at its outer periphery 28. The cavity 21a of the waveguide has a 63.5 mm diameter. The dimensions of the structure 26 are such that it will increasingly bow into the cavity 12*a* with increasing temperature to effectively change the cavity dimensions and generally offset the temperature-induced change in resonant frequency which would otherwise take place. The material used to form structure 26 should have a higher temperature co-efficient than the material forming the waveguide body, and may be slotted to minimize resistance to bending.

Figure 3:
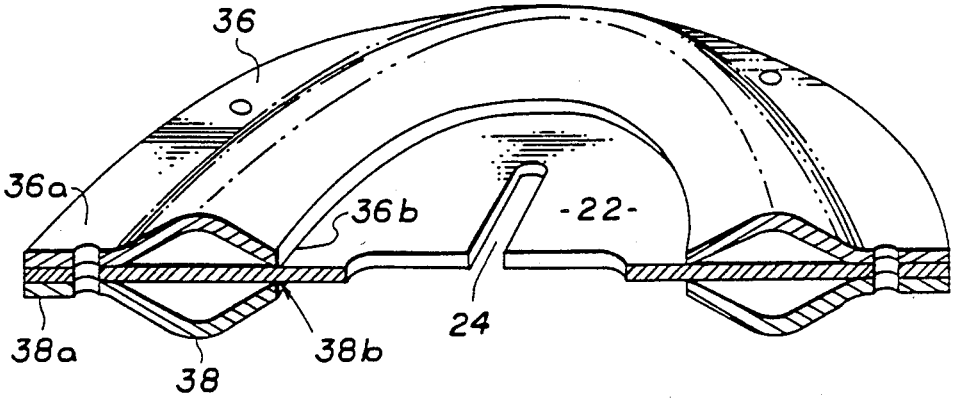
FIG. 3 is a perspective view in section of a thermally compensating coupling iris constructed in accordance with the invention.

The temperature-compensating structures need not be located at the endwalls of the body 10. For example, the coupling iris 22 may be provided with temperature compensating structure for one or both cavities 12*a*,12*b*. Reference is made to FIG. 3 which illustrates a cross-sectional view, in perspective, of a thermally compensating iris assembly which has been constructed in accordance with the invention. The assembly includes iris 22 having an orthogonally disposed pair of slots 24 which couples electromagnetic energy between adjoining cavities of the resonator. The iris is interjacent a pair of generally annular temperature-compensating structures 36,38, each of which has a generally axially bowed configuration. The structure 36,38 are affixed to the coupling iris about their respective outer peripheries 36*a*,38*a* and their respective inner peripheries 36*b*,38*b*.

When the coupling iris 22 is placed within a waveguide body such as body 10 (FIG. 1), the temperature-compensating structures 36,38 will increasingly protrude into the cavities 12*b*,12*a*, respectively with increasing temperature. Since each structure is affixed to the iris about its outer and inner periphery, the bowed shape will cause any temperature-induced dimensional change in the material to result in an increased, generally axially directed bowing of each structure.

In operation, thermally-induced expansion of the cavity would cause a lowering in the resonant frequency associated with that cavity. However, because the pre-formed bend in the structures 36,38 flex outward from the iris, effectively shortening the cavity length as the temperature increases, frequency shift that might otherwise occur is substantially offset. Naturally, when the temperature decreases, the reverse occurs. The cavity shrinks, but the temperature-compensating structure flattens at its bend to effectively lengthen the cavity and compensate for the resonator's dimensional change.

The structures 36,38 are formed from 0.5 mm thick copper and are affixed to an invar steel iris for use in a cavity having a diameter of 63.5 mm. The I.D. of the structures 36,38 are 15 mm, while the crest of the bow is 0.635 mm from the iris surface, and the width of the slots 24 is 1.57 mm.

A four section "4,2,0" mode resonator has been constructed having an invar housing with the aforedescribed dimensions. The resonator was operated as semi-elliptical filter with a 3.96 GHz resonant frequency and subjected to a temperature variation of 100° F. When the aforementioned iris of FIG. 3 replaced the standard coupling iris, the temperature-induced change in resonant frequency was substantially reduced from 0.6 MHz to 0.15 MHz.

As noted above, to minimize temperature-induced frequency changes, resonators have typically been constructed from materials having low thermal expansion co-efficients, such as invar steel. Such materials are poor heat conductors however and can actually melt at temperatures achievable in high-power satellites, owing to their inability to dissipate heat readily, unless cooling means are provided. The additional weight and mass of the cooling means and associated energy source are highly undesirable.

Accordingly, the resonator may conveniently be constructed from a body 10' of light-weight, thermally conductive material, such as aluminum. Although thermally conductive and able to dissipate heat relatively more easily than such low-expansion materials as invar, aluminum has not heretofore been thought acceptable for use as a waveguide material in satellites because of its relatively high co-efficient of expansion.

Ambient temperature cycles within a satellite can exceed 100° F., while aluminum waveguide resonator could not withstand a temperature change of more than ±10° F. and retain a resonant frequency variation within accepted tolerances.

Figure 2:
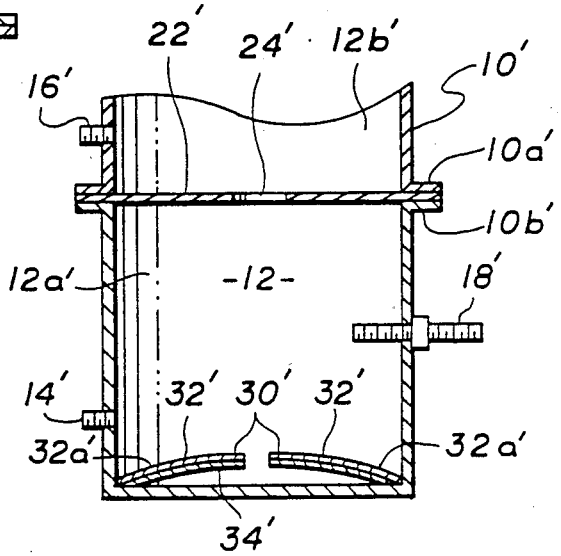
FIG. 2 is a longitudinal sectional view, in schematic, of an alternative embodiment of a cavity resonator constructed in accordance with the invention.

FIG. 2 shows an alternative embodiment of a resonator constructed in accordance with the invention and is particularly suitable for use with waveguide bodies formed from materials, such as aluminum, which have relatively higher temperature coefficients than invar steel. In order to offset the relatively greater degree of temperature-induced dimensional changes in the cavity, the temperature-compensating structure or elementis formed from essentially a plurality of bimetallic finger-like cantilevers 30'. In practice, two pair of opposing cantilevers have been utilized: the illustrated pair, plus a second opposing pair, offset 90° about the resonator axis from the illustrated pair.

The cantilevers 30' are affixed about their outer periphery **32*a'* to the waveguide body 10' and extend radially inward to form an effective endwall of cavity 12*a'*. The spacing between the cantilevers 30' is much smaller than the wavelength of the microwave energy, so that the face of the structure effectively appears gapless to the energy. The structure includes a first layer 32' of relatively low temperature co-efficient material, such as invar, which faces the cavity 12*a'*. The layer 32' is physically coupled to a second layer 34'** of relatively high temperature co-efficient material, such as brass.

As the temperature within the cavity **12*a'* rises, the material forming layer 34' will expand significantly more than the material forming layer 32', causing the cantilever 30' to bow increasingly into the cavity 12*a'*** in a generally axial direction.

In practice, the use of bimetallic cantilevers 30' can provide greater temperature-compensating movement than the type of temperature-compensating structure 26 described with respect to FIG. 1, and is therefore more preferable than the structure 26 when the waveguide body is formed from materials such as aluminum which exhibit a relatively high temperature coefficient. Naturally, the term "bimetallic" does not imply that the layer 32' and layer 34' need be formed from metals. Any suitable material may be utilized.

The temperature compensating structure illustrated in FIG. 2 may be adapted for use in an iris assembly. Turning to FIG. 4, a cross-section of a thermally compensating iris assembly is illustrated in perspective as comprising a bimetallic compensating element or structure 40 coupled to each opposite face of the iris 22. The iris 22 may be formed from a material of relatively high temperature co-efficient, such as aluminum.

Each compensating element 40 comprises essentially four circumferentially disposed, radially inward-extending cantilevers 41 separated by interjacent slots 43. The slots afford the cantilevers a permissible degree of axial movement, but are sufficiently narrow, relative to the energy wavelength, to be substantially invisible to the energy.

Each cantilever element 40 preferably comprises a first layer 42 formed from a material having a low temperature coefficient: preferably, a lower temperature co-efficient than the iris material. The first layer 42 may conveniently be formed from invar steel and forms the face of the cantilever which faces the adjacent cavity. A second layer 44 of relatively high temperature co-efficient material is physically coupled to the first layer 42 as by depositing the second layer on the first. Preferably, the layer 44 is a material such as brass which has a higher temperature co-efficient than both the iris material and the waveguide body.

It will be appreciated that each structure 40 operates similarly to the temperature-compensating structure 30 illustrated in FIG. 2. Specifically, an increase in temperature causes the layer 44 to undergo greater expansion than that experienced by the layer 42, thereby causing the cantilevers 41 to curl away from the iris 22 and thereby move generally axially into the cavity to effectively decrease the cavity length.

In practice, structure 40 has been constructed for use in 63.5 mm inner diameter cavities. The cantilevers 41 have a width of 12.7 mm at their radially inner ends, which ends are spaced axially from the face of iris 22 by 15.25 mm. The radially inner end of each cantilever 41 is seperated by 21 mm from the radially inner end of the opposing cantilever. The slot 43 width between adjacent cantilevers is 6.35 mm.

A four section "4,2,0" mode resonator having an aluminum housing and 63.5 mm diameter cavity was operated as a semielliptical filter with a 4 GHz resonant frequency and subjected to a temperature variation of 100° F. When an iris constructed in accordance with the embodiment of FIG. 4 and the aforementioned dimensions was substituted for the standard coupling iris, the temperature-induced resonant frequency change was reduced from 2.9 MHz to 0.3 MHz.

In addition to mounting temperature-compensating structures on cavity endwalls, temperature-compensating means may be provided on the sidewalls of the cavity. However, since resonant frequency shift is proportional to the lateral dimension of the cavity, the temperature-compensating structure must effectively increase the lateral dimension of the cavity with increasing temperature. Accordingly, FIG. 5 illustrates a fragmentary sectional view of a resonator, in schematic, wherein the temperature-compensating structure is mounted on the sidewall of the cavity. The structure 46 is formed from a metal which can conveniently be the same metal as the housing. The structure 46 is positioned on the distal end 56, of a pre-bent bimetallic element 48 affixed to the sidewall 50 of the cavity 12. The structure 46 is preferably positioned where the magnitude of the electromagnetic energy is near a maximum, i.e. at or near $K2/_2$ from an endwall, where K is an integer. The pre-bent bimetallic element 48 comprises a first layer of material 52 having a relatively low temperature co-efficient, such as invar, and a second layer 54 of relatively greater temperature co-efficient, such as brass.

When the temperature increases, material 54 expands at a greater rate than material 52, thereby causing the distal end 56 of the element 48 to move generally transversely away from the central axis 20 of the resonator cavity, pulling element 46 transversely outward towards the cavity sidewall 50. The transverse movement of the element 46 towards the sidewall 50 away from the axis effectively increases the diameter of cavity 12, thereby substantially offsetting the temperature-induced change in resonant frequency.

It is also possible to compensate for temperature-induced dimensional changes in the cavity by providing a tuning screw having an effective variable diameter. As the effective diameter of a tuning screw decreases, the resonant frequency of a cavity increases owing to a decrease in concentration of the electromagnetic field in the space formerly occupied by the metal.

Accordingly, the invention in one form comprises a resonator having a tuning screw which includes temperature-responsive means for varying the effective diameter of the tuning screw to the degree necessary to effectively offset the temperature-induced resonant frequency change. With reference to FIG. 6, a tuning screw 60 is illustrated schematically as including a threaded proximal end 65 and a distal end 67 which comprises a plurality of circumferentially disposed, bimetallic, cantilever-like elements 62,64,66. The cantilever elements 62,64,66 are joined at their proximal end 68 to the threaded end of the tuning screw so as to extend into the cavity from the side wall. Each cantilever element comprises an inner layer of low temperature co-efficient material such as invar steel and an outer layer of relatively high temperature co-efficient material, such as brass. The cantilever elements 62,64,66 are provided with a circumferentially curved shape and are spaced from each other by slot so that the curvature of the elements is steepened by the relatively greater expansion of the brass. The sharpened curvature, coupled with the flexibility provided by the slots, permits the elements to bend inward towards the central axis of the screw and effectively decreases the screw diameter. Since the smaller diameter tends to increase the resonant frequency of the cavity, the temperature-induced decrease in resonant frequency caused by dimensional changes in the cavity is substantially offset.

In practice, the width of the element-separating slots is approximately 0.75 mm, a dimension much smaller than the approximately 25 mm wavelength of the resonant electromagnetic energy. For all practical purposes, the cantilevered configuration appears as a solid shape of variable cross-section to the energy.

The preceding description has presented, in detail, exemplary preferred ways in which the concepts of the present invention may be applied. Those skilled in the art will recognize that numerous alternatives encompassing many variations may readily be employed without departing from the spirit and scope of the invention set forth in the appended claims.

I claim:

1. A cavity resonator comprising:

a waveguide body having a cavity sized to maintain electromagnetic waves of one or more selected resonant frequencies;

means for coupling electromagnetic energy into and out of the resonator;

at least one tuning screw for adjusting the resonant frequency of the cavity; and temperature-compensating structure within the cavity configured to undergo temperature-induced dimensional changes which substantially minimize the resonant frequency change which would otherwise be caused by the temperature-induced dimensional change of the waveguide body cavity and also including temperature responsive means for varying the effective diameter of the at least one tuning screw to substantially minimize temperature induced frequency changes.

2. The resonator of claim 1 wherein the waveguide body is disposed about a generally central axis, the axial dimension of the cavity is defined by a pair of axially spaced end wall members, and the temperature-compensating structure forms at least a portion of one of said end-wall members, the structure being configured to increasingly protrude into the cavity with increasing temperature and to decreasingly protrude into the cavity with decreasing temperature so as to substantially offset temperature-induced changes in resonant frequency.

3. The resonator of claim 2 wherein said temperature-compensating structure is coupled about its periphery to the endwall of the cavity and includes a generally central region bowed axially into the cavity.

4. The resonator of claim 2 wherein the temperature-compensating structure includes a bimetallic cantilever-like element coupled to the endwall.

5. The resonator of claim 4 wherein the temperature-compensating structure is generally annular in shape and includes a plurality of cantilever structures the structure being affixed about its outer periphery to the endwall.

6. The resonator of claim 4 wherein the bimetallic cantilever element is generally annular in shape and includes a generally planar base supporting a layer of material having a lower temperature expansion coefficient than the base, said layer facing the opposite end of the cavity, whereby the bimetallic element increasingly flexes into the cavity with increasing temperature.

7. The resonator of claim 1 including a generally annular temperature-compensating structure having a bowed configuration between its outer and inner peripheries, the temperature-compensating structure being coupled to an endwall of the cavity so as to increasingly protrude into the cavity with increasing temperature.

8. The resonator of claim 7 wherein the annular structure is affixed to the endwall along its inner and outer peripheries.

9. The resonator of claim 1 including a cavity sidewall disposed about a generally central axis, the temperature-compensating structure being coupled to the sidewall and configured to decreasingly protrude into the cavity with increasing temperature and to increasingly protrude into the cavity with decreasing temperature to substantially minimize temperature-induced changes in resonant frequency.

10. A cavity resonator comprising:

a waveguide body formed from a material having a relatively high co-efficient of thermal conductivity, said body having a cavity sized to maintain electromagnetic waves of one or more selected resonant frequencies;

means for coupling electromagnetic energy into and out of the resonator;

at least one tuning screw for adjusting the resonant frequency of the cavity, temperature-compensating structure within the cavity configured to undergo temperature-induced dimensional changes which substantially minimize the resonant frequency change which would otherwise be caused by the temperature-induced dimensional change of the waveguide body cavity and also including temperature responsive means for varying the effective diameter of the at least one tuning screw to substantially minimize temperature induced frequency changes.

11. The resonator of claim 10 wherein the body material is aluminum.

12. The resonator of claim 10 wherein the waveguide body is disposed about a generally central axis, the axial dimension of the cavity is defined by a pair of axially spaced endwall members, each endwall member, further comprising a coupling iris, the temperature-compensating structure forms at least a portion of one increasingly protrude into the cavity with increasing temperature and to decreasingly protrude into the cavity with decreasing temperature so as to substantially offset temperature-induced changes in resonant frequency of said endwall members, the structure being configured to increasingly protrude into the cavity with increasing temperature and to decreasingly protrude into the cavity with decreasing temperature so as to substantially offset temperature-induced changes in resonant frequency.

13. The resonator of claim 12 wherein the temperature-compensating structure includes a bimetallic cantilever-like element coupled to the endwall member.

14. The resonator of claim 13 wherein the temperature-compensating structure is generally annular in shape and includes a plurality of cantilever structures the structure being affixed about its outer periphery to the endwall member.

15. The resonator of claim 14 wherein the bimetallic cantilever element is generally annular in shape and includes a generally planar base supporting a layer of material having a lower temperature expansion coefficient than the base, said layer facing the opposite end of the cavity, whereby the bimetallic element increasingly flexes into the cavity with increasing temperature.

16. The resonator of claim 10 wherein the waveguide body is disposed about a generally central axis, the axial dimension of the cavity is defined by a pair of axially spaced endwalls, the temperature-compensating structure forms at least a portion of one of said endwalls, the structure being configured to increasingly protrude into the cavity with increasing temperature and to decreasingly protrude into the cavity with decreasing temperature so as to substantially offset temperature-induced changes in resonant frequency.

17. A coupling iris assembly for use in a cavity resonator and comprising:

(a) a base of material having a pair of opposing faces, and an electromagnetically transparent slot communicating with said faces adapted to couple electromagnetic energy through the base when the coupling iris is positioned within a cavity resonator; and (b) a first structure which further comprises a generally bow-shaped, generally annular member coupled about its outer and inner peripheries to the base, the first structure including material having a higher temperature expansion co-efficient than the base and positioned on a face of the base to protrude into the cavity from the base when the base is mounted in the cavity resonator, the position and expansion co-efficient of the first structure material being such that it increasingly protrudes into the cavity in response to increasing temperature sufficiently to substantially minimize temperature-induced resonant frequency changes of the cavity.

18. The coupling iris of claim 17 wherein the first structure is made from a material selected from the group consisting of brass and copper.

19. The coupling iris of claim 17 including a second structure substantially identical to the first structure and positioned on the opposite face of the base.

20. The coupling iris of claim 17 wherein the structure includes a plurality of cantilevered elements extending generally inwardly towards the center of the face from the outer periphery of the face, the elements being coupled at their outer peripheries to the base and configured to increasingly protrude into the resonator cavity with increasing temperature to substantially minimize the temperature-induced resonant frequency change of the cavity when the iris is mounted in the resonator cavity.

21. The coupling iris of claim 20 wherein the cantilevered elements are formed from a plurality of generally parallel layers of material, at least two of said layers differing in their thermal expansion coefficients sufficiently to amplify the protruding movement of the element.

22. The coupling iris of claim 21 wherein one of said two layers is formed from invar steel.

23. The coupling iris of claim 21 wherein one of said two layers is formed from a material selected from the group consisting of copper and brass.

* * * * *